United States Patent [19]

Uesugi et al.

[11] Patent Number: 4,598,790

[45] Date of Patent: Jul. 8, 1986

[54] HEAT AND SOUND INSULATION DEVICE

[75] Inventors: Naomoto Uesugi, Tokyo; Shoji Suzuki, Aichi, both of Japan

[73] Assignee: Honda Giken Kogyo Kabushiki Kaisha, Tokyo, Japan

[21] Appl. No.: 650,634

[22] PCT Filed: Jan. 20, 1984

[86] PCT No.: PCT/JP84/00013

§ 371 Date: Nov. 8, 1984

§ 102(e) Date: Nov. 8, 1984

[87] PCT Pub. No.: WO84/02954

PCT Pub. Date: Aug. 2, 1984

[30] Foreign Application Priority Data

| | | | |
|---|---|---|---|
| Jan. 20, 1983 | [JP] | Japan | 58-6588 |
| Feb. 22, 1983 | [JP] | Japan | 58-24929[U] |
| Feb. 25, 1983 | [JP] | Japan | 58-30502 |
| Feb. 28, 1983 | [JP] | Japan | 58-28876[U] |
| Feb. 28, 1983 | [JP] | Japan | 58-28866[U] |

[51] Int. Cl.[4] ..... F01N 1/10

[52] U.S. Cl. ..... 181/252; 181/272

[58] Field of Search ..... 181/231, 243, 244, 246, 181/249, 250, 252, 255, 256, 229, 272

[56] References Cited

U.S. PATENT DOCUMENTS

| | | | |
|---|---|---|---|
| 3,233,697 | 2/1966 | Slayter et al. | 181/252 |
| 4,015,683 | 4/1977 | Williams | 181/231 |
| 4,192,402 | 3/1980 | Nakagawa et al. | 181/256 |
| 4,234,054 | 11/1980 | Chapin | 181/249 X |
| 4,332,307 | 1/1982 | Ito | 181/256 |
| 4,456,091 | 6/1984 | Blanchok | 181/243 X |

FOREIGN PATENT DOCUMENTS

| | | |
|---|---|---|
| 47-24549 | 8/1972 | Japan . |
| 52-92902 | 8/1977 | Japan . |
| 53-22661 | 6/1978 | Japan . |
| 54-29393 | 9/1979 | Japan . |
| 55-71142 | 5/1980 | Japan . |
| 56-7974 | 2/1981 | Japan . |
| 56-64114 | 6/1981 | Japan . |
| 56-83620 | 7/1981 | Japan . |
| 57-48592 | 10/1982 | Japan . |
| 58-79891 | 5/1983 | Japan . |

*Primary Examiner*—Benjamin R. Fuller

*Attorney, Agent, or Firm*—Armstrong, Nikaido, Marmelstein & Kubovcik

[57] ABSTRACT

A heat and sound insulation device including a heat and sound insulation material composed of a laminated body comprising elongate glass fibers and ceramic fibers mixed therewith, the heat and sound insulation material having an inner surface entirely exposed in an exhaust passage for increased heat insulation, sound insulation, and durability.

10 Claims, 19 Drawing Figures

2
202
203
204
205
206
207
208
209
211
212
213
214
215
218
219
219a
219b
220
221
222
222a
222b
223
224
225
7
8

HEAT AND SOUND INSULATION DEVICE

TECHNICAL FIELD

The present invention relates to a heat and sound insulation device for use in a high-temperature exhaust passage such as an exhaust pipe for an internal combustion engine.

BACKGROUND ART

So-called mufflers are connected to exhaust pipes for reducing the noise of an exhaust gas discharged from a heat source such as an internal combustion engine in which the exhaust pressure widely varies. As shown in FIGS. 17 and 18, one conventional muffler is constructed of an outer muffler panel (91), filamentary glass fibers (92) attached to an inner surface of the outer muffler panel (91), and punched panels (93) held against inner surfaces of the glass fibers to hold the glass fibers. This construction is poor in heat insulation since the punched panels (93) which is a good thermal conductor and the outer muffler panel (91) are held in contact with each other through wide areas (94).

As shown in FIG. 19, there has been proposed a muffler for being mounted on a motorcycle engine which has a small displacement, the muffler comprising a silencer (96) made of glass fibers baked and pressed into a mat with an organic binder and attached to an inner surface of an outer panel (95). Since the binder is organic, the proposed muffler is of poor heat resistance. The heat resistance has been improved by employing an inorganic binder. However, the muffler is disadvantageous in that the silencer (96) has a low density of 150 $Kg/m^3$, the glass fibers are joined together with small binding forces, the surfaces of the glass fibers of the silencer tend to split finely due to an exhaust gas flow, resulting in poor durability and an increased resistance to the exhaust gas flow thereby to impair the exhaust gas inertia.

Disclosure of the Invention:

The present invention has been made in an effort to eliminate the above difficulties with the heat and sound insulation device of the type in which glass fibers are attached to an inner wall.

It is an object of the present invention to provide a heat and sound insulation device in which fibers are joined with strong binding forces, and which is highly heat-resistant and durable.

To achieve the above object, a heat and sound insulation material is exposed on the surface of an inner surface of an exhaust passage, and comprises a laminated body composed of elongate glass fibers with fibrous ceramic mixed therewith.

Embodiments of the present invention will hereinafter be described in detail with reference to the accompanying drawings. Specific constructions and advantages of the present invention will be understood from the description of the invention.

BEST MODE FOR CARRYING OUT THE INVENTION

Figure 2:
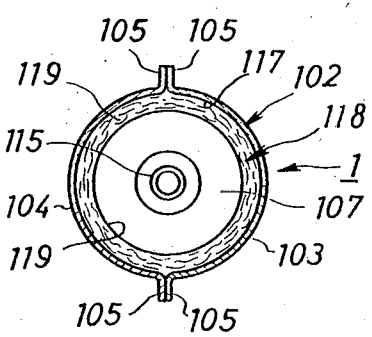
FIG. 2 is a cross-sectional view taken along line 2—2 of FIG. 1.
Figure 1:
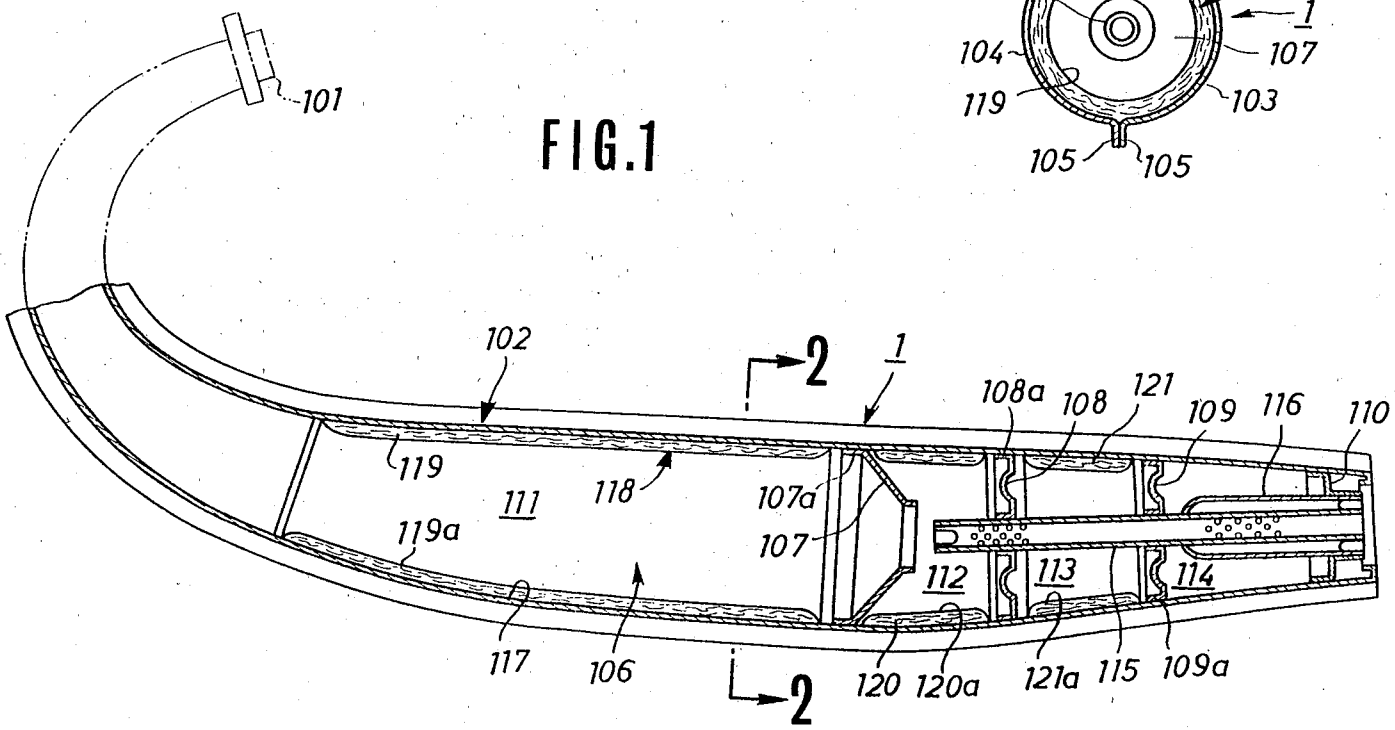
FIG. 1 is a longitudinal cross-sectional view of a muffler for an internal combustion engine according to a first embodiment of the present invention.

Designated in FIGS. 1 and 2 at (1) is a muffler having an end (101) to be detachably connected to an exhaust pipe of a motorcycle engine, not shown. The muffler includes an outer muffler panel (102) forming an outer profile of the muffler (1) and composed of two semicircular symmetrical halves (103), (104) formed as by pressing and parted by a longitudinal plane. The halves have flanges (105), . . . bent and extending radially outwardly on their mating surfaces and held in abutment and welded together to provide the outer panel (102) which has a chamber of a circular cross section.

According to the embodiment, the chamber (106) surrounded by the outer panel (102) is divided by partitions (107), (108), (109), and an end plate (110) into compartments (111), (112), (113), (114) arranged in the order named in the direction in which an exhaust gas flows. An apertured tail pipe (115) extends from the partition (108) to the end plate (110) to vent the compartment (112) to atmosphere. A blind pipe (116) is disposed in surrounding relation to a rear portion of the tail pipe (115) which is located in the compartment (114).

A heat and sound insulation material (118) is attached to an inner peripheral wall (117) of the outer panel (102) of the muffler (1). As shown in FIG. 2, the sound insulation material is held against the overall circumferential surface of the inner wall uninterruptedly in complementary relation to the cross-sectional shape of the inner wall, the sound insulation material being ring-shaped in the embodiment. According to the embodiment, a sound insulation material (119) extends from an upstream portion to a downstream portion of the first upstream compartment (111), and terminates at a position in front of the partition (107). A sound insulation material (120) is attached to the inner circumferential wall of the second compartment (112) between the partitions (107), (108), and a sound insulation material (121) is attached to the inner circumferential wall of the third compartment (113) between the partitions (108), (109). The sound insulation materials avoid attachment flanges (107*a*), (108*a*), and (109*a*) of the partitions (107), (108), and (109) which are attached to the inner circumferential surface of the outer panel.

The heat and sound insulation materials (119), (120), (121), which are represented by (118), in the compartments (111), (112), (113) have inner circumferential surfaces (119), (120), and (121) exposed in an exhaust passage which are constituted of the compartments.

The heat and sound insulation matirials as described above are constructed as follows:

Elongate glass fibers are mixed with ceramic fibers mainly composed of 45% of kaolin and 52% of silicic acid to form a wad, which is coated or impregnated with an inorganic binder formed of water glass. The resultant fibrous body is pressed by a die which is complementary in shape to the inner circumferential surface of the outer panel (102) of the muffler (1) to provide a heat and sound insulation material having a density of about 200 Kg/m$^3$ or greater. The heat and sound insulation material is then attached flatwise to the inner circumferential surface of the outer panel (102) uninterruptedly.

Figure 3:
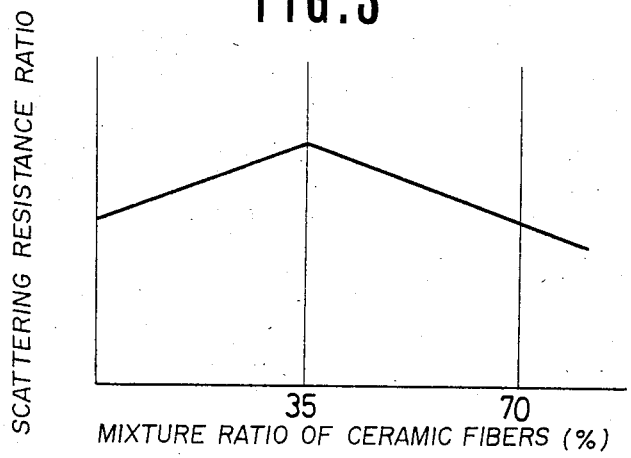
FIG. 3 is a diagram showing the relationship between a ceramic fiber mixture ratio and a scattering resistance ratio of a heat and sound insulation material.
Figure 4:
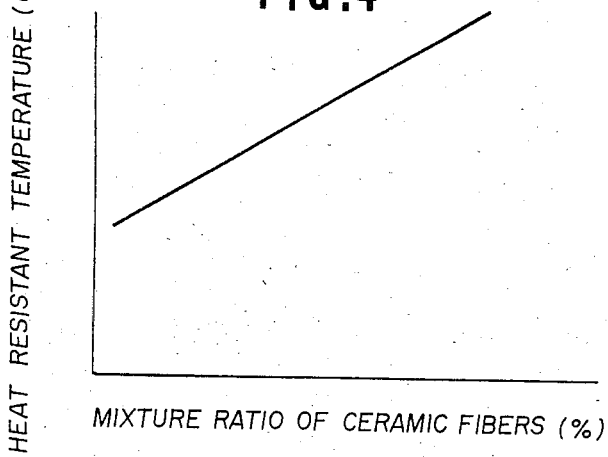
FIG. 4 is a diagram illustrative of the relationship between a ceramic fiber mixture ratio and a heat resistant temperature of the heat and sound insulation material.

The ratio of mixture of the ceramic fibers in the heat and sound insulation material (the weight of ceramic fibers/(the weight of glass fibers+ the weight of ceramic fibers)×100) is about 35%. Where the heat resistant capability and the scattering resistance ratio (the resistance to being split finely) are taken into account, the mixture ratio may be in the range of from 35% to 70% as shown in FIGS. 3 and 4.

Figure 5:
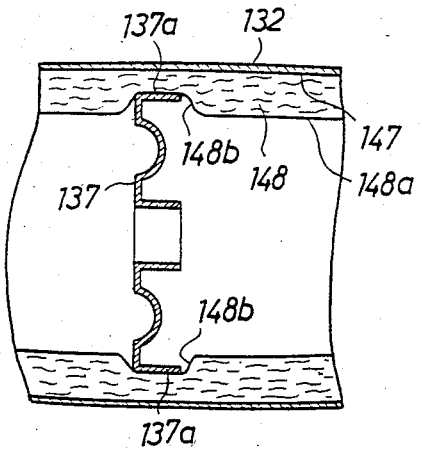
FIG. 5 is a fragmentary longitudinal cross-sectional view of a modification.

FIG. 5 shows an embodiment in which a heat and sound insulation material (148) identical to the above heat and sound insulation material is applied to the overall surface of an inner circumferential wall (147) of an outer panel (132), and has a surface (148*a*) exposed in an exhaust passage and having circumferential recesses (148*b*) in which outer circumferential flanges (137*a*) of a partition (137) are fitted. This arrangement allows an increased area of the heat and sound insulation material since no partitions (107), (108), (109) are secured directly to the inner circumferential wall of the outer panel.

The muffler (1) is effective in guiding an exhaust gas discharged from the engine through an exhaust pipe to the muffler (1), in which the exhaust gas flows into the first compartment (111), is introduced into the second compartment (112), and then is discharged through the tail pipe (115) into atmosphere. When the exhaust gas passes through the apertured tail pipe (115), it enters and leaves the third compartment (113), the fourth compartment (114), and the blind pipe (116) through the apertures in the tail pipe, during which time the acoustic energy of the exhaust gas is attenuated and absorbed through expansion, reflection, resonance, and the like. The absorption and attenuation of the exhaust gas noise is further promoted by the heat and sound insulation materials (119), (120), and (121) applied to the inner circumferential walls of the first, second, and third compartments (111), (112), and (113), with the result that the exhaust noise can effectively be reduced and silenced.

Since the heat and sound insulation materials (119), (120), and (121) are present uninterruptedly on the inner circumferential surface of the outer muffler panel (102), the exhaust gas is prevented from contacting the outer muffler panel (102) to avoid external radiation of exhaust heat as much as possible. Thus, the temperature of the exhaust gas in the muffler is kept high with the result that the exhaust gas temperature matches the period in which the engine discharges the exhaust gas, achiving a sufficiently high cadency effect and a wider power band.

Furthermore, because the exhaust gas temperature in the muffler is kept high, oil and water in the exhaust gas are prevented from being liquidized. Therefore, no liquid is clogged in the apertures in the tail pipe or attached therein to narrow the apertures, so that any power loss due to an increased exhaust pressure will be prevented.

By selecting the ceramic fiber mixture ratio in the heat and sound insulation materials (119), (120), and (121) to be 35%, the scattering resistance ratio becomes maximum as shown in FIG. 3, and the heat resistant temperature reaches 650° C. or higher. As the fiber density is about 200 Kg/m$^3$, the heat and sound insulation materials are formed as retaining their own shapes, rather than being glass wool, and they can fixed in position simply by being held against the inner circumferential surface of the outer panel, without the need for any fixing means.

When a high-temperature exhaust gas passes at a high speed through the muffler while the engine operates at a high speed to produce a high output, the heat and sound insulation material is not split finely and can maintain their original configuration securely for a long period of time. As a consequence, the heat and sound insulation materials are highly durable, and capable of sound insulation in a wide range from low to high frequencies as they are high in density.

With the outer muffler panel kept from being subjected to a high-temperature exhaust gas, it is prevented from being heated to high temperature, and can be plated or painted in a simple process, resulting in a cost reduction.

If the heat insulation capability of the heat and sound insulation materials is to be increased, then the mixture ratio of the ceramic fibers should be increased as is apparent from FIG. 4. While in the above embodiment the heat source is indicated as an automotive gasoline engine, the present inventio is applicable to other heat sources such as fan heaters, including diesel engines, which continuously discharge a high-temperature gas. This holds true for the following embodiments.

Figures 6, 7, 8:
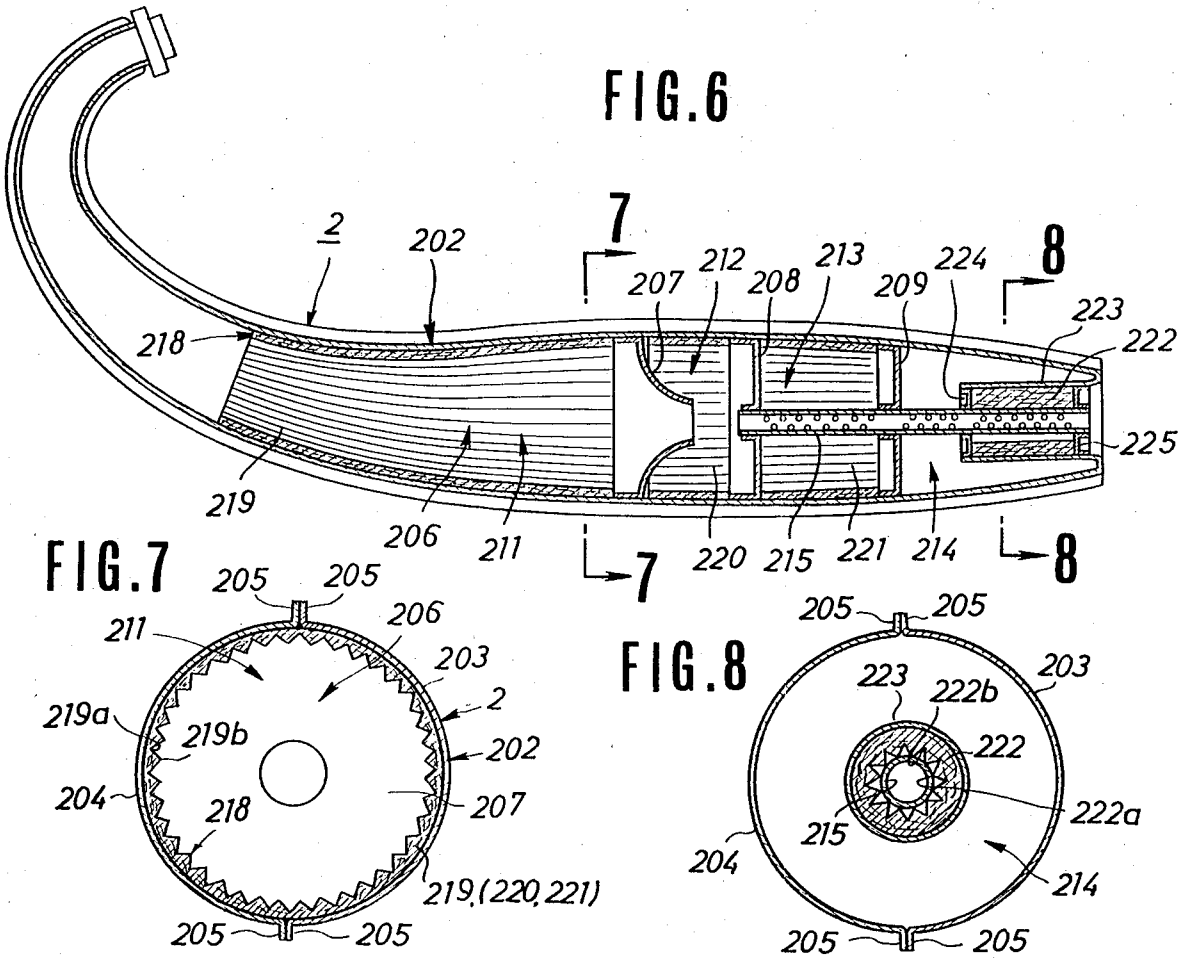
FIG. 6 is a longitudinal cross-sectional view of a second embodiment.
FIG. 7 is an enlarged cross-sectional view taken along line 7—7 of FIG. 6.
FIG. 8 is an enlarged cross-sectional view taken along line 8—8 of FIG. 6.
Figure 9:
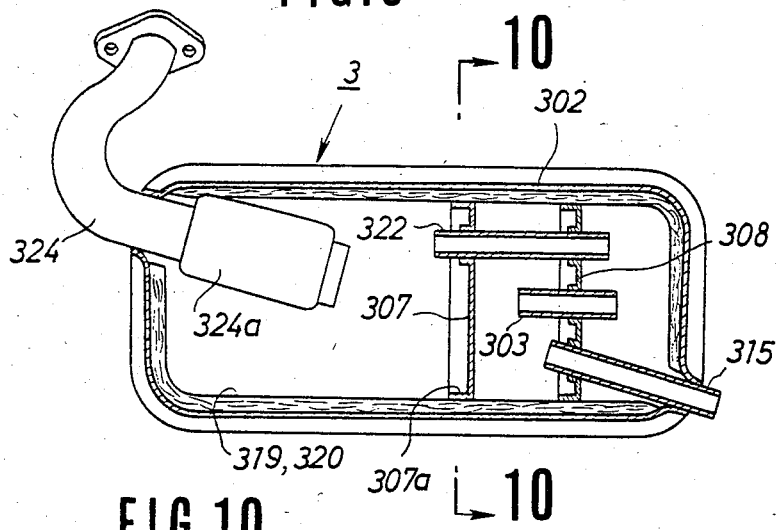
FIG. 9 is a longitudinal cross-sectional view of a third embodiment.

FIGS. 6 through 8 illustrate a second embodiment of the present invention.

A muffler (2) has an outer panel (202), halves (203), (204), couping flanges (205), . . . , a chamber (206), partitions (207), (208), (209), an apertured tail pipe (215), compartments (211), (212), (213), (214) divided by the compartments, a heat and sound insulation material (218), which is composed of individual heat and sound insulation materials (219), (220), (221) attached to inner circumferential walls of the compartments. Since the muffler is of the same type as that of the foregoing muffler, the components will not be described specifically.

As shown in FIG. 7, the heat and sound insulation material (219) is attached to the inner circumferential wall of the outer panel (202), and is in the form of a tubular shape having an inner peripheral surface exposed in an exhaust gas passage and formed as a serrated configuration having sharp grooves (219*a*) and ridges (219*b*) which are successively arranged in the circumferential direction, the grooves (219*a*) and the ridges (219*b*) extend longitudinally of the heat and sound insulation material. The heat and sound insulation mateirals (220), (221) the other compartments are of the same construction.

A tubular heat and sound insulation material (222) of a serrated cross section having grooves (222*a*) and ridges (222*b*) on its inner peripheral surface is disposed in surrounding relation to a rear portion of the tail pipe (215) which is exposed in the final fourth compartment (214). The sound insulation material (222) has an outer peripheral surface held by a cylindrical holder (223) and front and rear ends closed by end plates (224), (225).

With this arrangement, the surface area of the circumferential wall surface of the heat and sound insulation material which is exposed in the exhaust gas passage, that is, the sound absorbing area, is increased for improving the ability to absorb and attenuate exhaust gas sounds. In mufflers for motorcycles which have limited outer muffler sizes, heat and sound insulation materials can be mounted, and their sound absorbing areas can be increased.

FIGS. 9 through 12 illustrate a third embodiment which is preferred as a muffler (3) for a motorcycle having a small displacement.

A tubular outer muffler panel (302) is formed by welding or otherwise joining flanges (305), . . . at mating surfaces of semicircular halves (303), (304) having front and rear end walls (303*a*), (303*b*), (304*a*), (304*b*). A heat and sound insulation material (308) attached to an inner surface of the outer panel (302) is composed of joined halves (319), (320) having front and rear end walls (319*a*), (319*b*), (320*a*), (320*b*). The halves (319), (320) have holes (319*c*), (319*d*), (320*c*), (320*d*) defined in peripheral walls thereof and spaced longitudinally.

Figure 12:
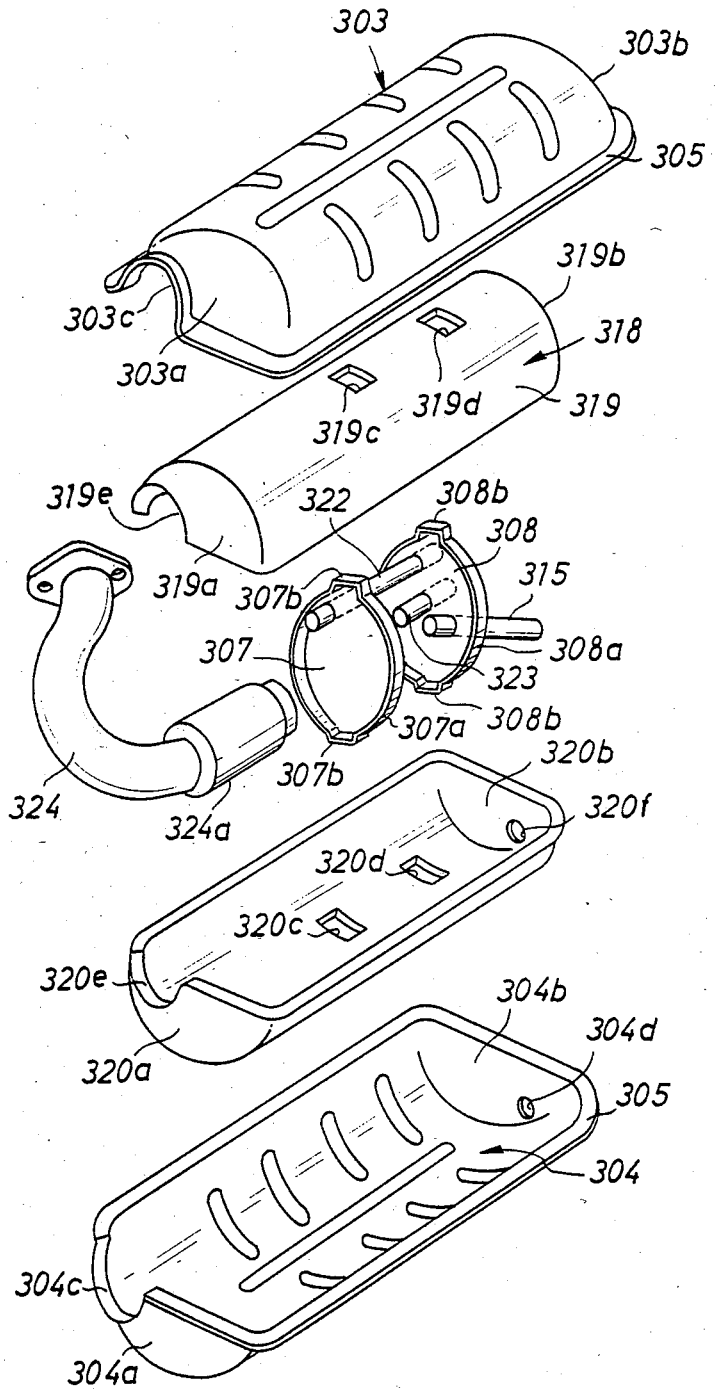
FIG. 12 is an exploded perspective view of the muffler according to the third embodiment.

In the embodiment, two partitions (307), (308) have outer peripheral flanges (307*a*), (308*a*) held in abutment against the inner surface of the tubular body composed of the joined halves (319), (320) of the heat and sound insulation material. The flanges (307*a*), (308*a*) have projections (307*b*), (307*b*), (308*b*), (308*b*), which are two for each flange and spaced 180° according to the embodiment. A communication pipe (322) extends through the partitions (307), (308) and interconnects them. A communication pipe (323) is joined to the rear partition (308) to provide communication between compartments in front of and behind the rear partition. A long tail pipe (315) is also coupled to the rear partition (308) and has an end led out of the muffler. Such partition unit is preassembled as shown in FIG. 12.

The front end plates (303*a*), (319*a*), (320*a*), (304*a*) of the halves (303), (304), (319), (320) have semicircular recesses (303*c*), (319*e*), (320*e*), (304*c*) defined therein, and the rear end plates (320*b*), (304*b*) of the halves (320), (304) have holes (320*f*), (304*d*), respectively.

Figure 10:
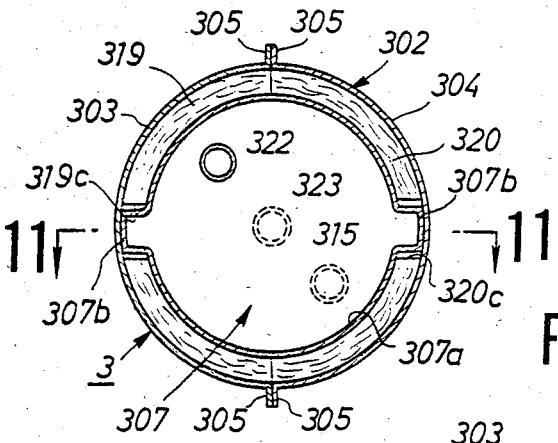
FIG. 10 is a cross-sectional view taken along line 10—10 of FIG. 9.
Figure 11:
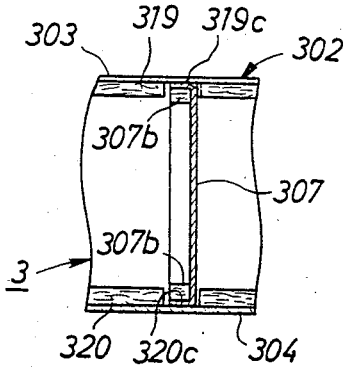
FIG. 11 is a cross-sectional view taken along line 11—11 of FIG. 10.

An exhaust pipe (324) connected to an exhaust port of an internal combustion engine has a downstream portion (324*a*) extending through the recesses (320*e*), (319*e*) into the muffler. In the embodiment, the downstream portion (324*a*) serves as a submuffler. The partitions (307), (308) are positioned between the halves (319), (320) with the projections (307*b*), (308*b*) engaging in the holes (319*c*), (319*d*), (320*c*), (320*d*) and being positioned therein. A downstream portion of the tail pipe (315) is fitted in the hole (320*f*), and the halves (303), (304) are fitted over the assembly with the exhaust pipe (324) led out from the recesses (303*c*), (304*c*) and the downstream portion of the tail pipe (315) being led out from the hole (304*d*). The halves (303), (304) are joined together by the flanges (305). As shown in FIGS. 10 and 11, the projections (307*b*), (308*b*) are held against the inner surface of the outer panel through the holes (319*c*), (319*d*), (320*c*), (320*d*), and secured in position by being spot-welded or otherwise joined.

With the foregoing embodiment, the muffler can be manufactured by forming the heat and sound insulation material as two halves, unitizing the partitions, setting the exhaust pipe, setting the partitions, mating and welding the halves. Therefore, the muffler can easily be manufactured, and lends itself to mass production, resulting in a reduction in the cost of manufacture. The partitions can be spot-welded rather than being welded along their entire peripheries to the outer panel, and can reliably be supported as they are partially coupled to the outer panel. Because the partitions are partly in contact with the outer panel, the transfer of the heat of an exhaust gas to the outer panel is reduced to a minimum, so that the heat and sound insulation material has an increased heat insulation capability.

Figure 13:
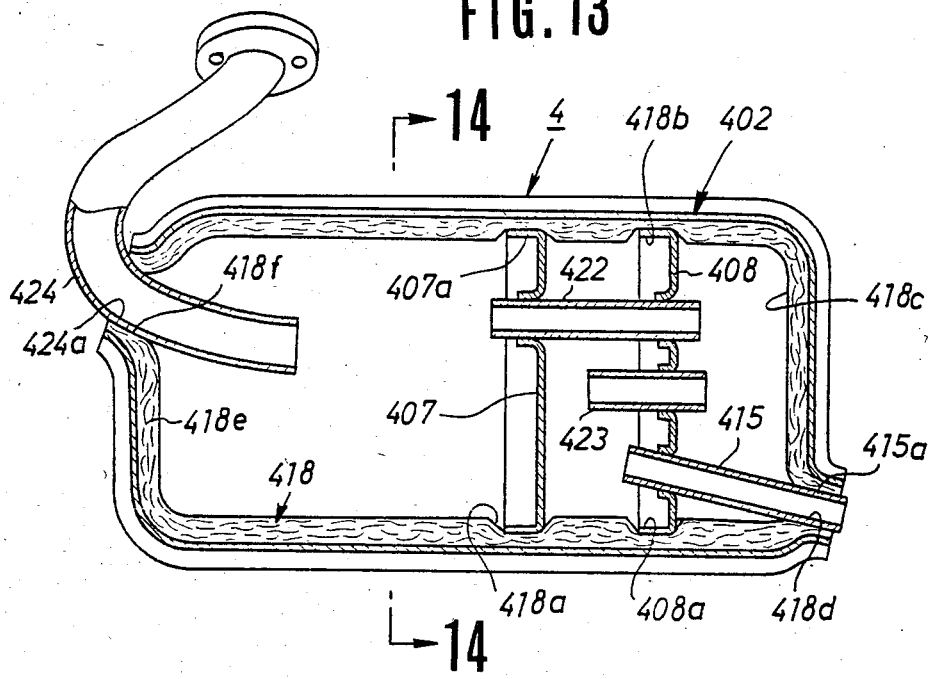
FIG. 13 is a longitudinal cross-sectional view of a fourth embodiment.
Figure 14:
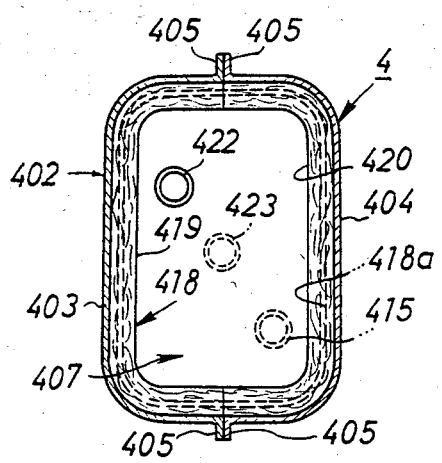
FIG. 14 is a cross-sectional view taken along line 14—14 of FIG. 13.

FIGS. 13 and 14 are illustrative of a fourth embodiment in which the arrangement of FIG. 5 that is shown as a modification of the embodiment of FIG. 1 is employed as a muffler (4) for exclusive use on a motorcycle of a small displacement.

As shown in FIG. 14, the muffler (4) has an outer profile of a rectangular box-shaped transverse cross section. The muffler includes an outer panel (402) comprises lateral halves (403), (404) coupled together by end flanges (405), and a heat and sound insulation material (418) composed of lateral halves (419), (420) disposed in the outer panel. The halves (419), (420) have recesses (418*a*), (418*b*) spaced longitudinally and extending fully along an inner circumferential surface. Flanges (407*a*), (408*a*) of partitions (407), (408) engage in the recesses (418*a*), (418*b*) A communication pipe (422) extends between the partitions (407), (408). A communication pipe (423) and a tail pipe (415) are coupled to the partition (408). The tail pipe (415) includes a downstream portion (415*a*) led out through a tubular hole (418*d*) defined in a rear end wall (418*c*) of the heat and sound insulation material with an outer peripheral surface of the downstream portion (415*a*) being out of contact with the outer panel (402). An exhaust pipe (424) has an intermediate portion (424*a*) fitted in a tubular hole (418*f*) in a front end wall (418*e*) of the heat and sound insulation material, and led out while out of contact with the outer panel (402).

In the above arrangement, the partitions (407), (408) are held out of contact with the outer panel (402), and so are the tail pipe (415) and the exhaust pipe (424). Accordingly, the heat of an exhaust gas flow is prevented from being tranferred to the outer panel through the partitions, the tail pipe, and the exhaust pipe, so that the outer panel can be prevented from being heated. The outer panel can therefore be plated or painted more easily than with conventional arrangements. A wide choice is available of temperatures in painting, and a wide selection of colors is given for colorful painting. In addition, the construction is advantageous in point of cost.

Figure 15:
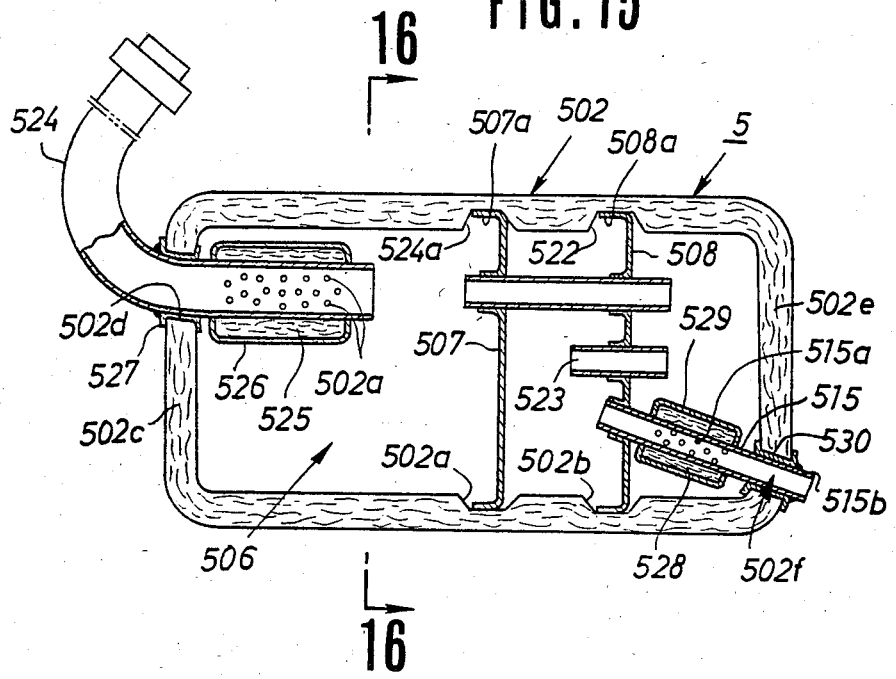
FIG. 15 is a longitudinal cross-sectional view of a fifth embodiment.
Figure 16:
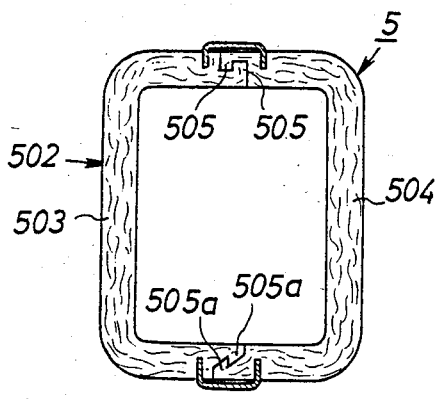
FIG. 16 is a cross-sectional view taken along line 16—16 of FIG. 15.
Figure 17:
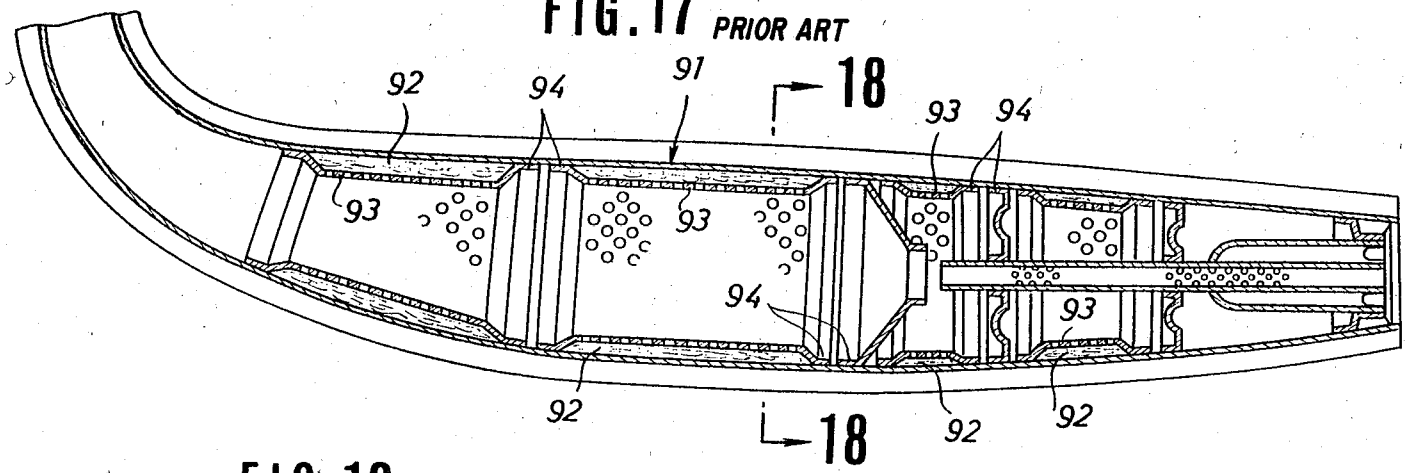
FIG. 17 PRIOR ART
FIG. 17 is a longitudinal cross-sectional view of a conventional muffler.
Figure 18:
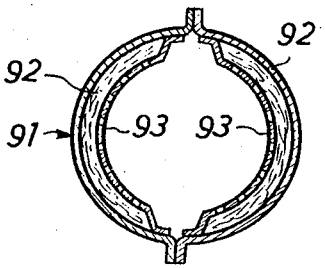
FIG. 18 PRIOR ART
FIG. 18 is a cross-sectional view taken along line 18—18 of FIG. 17.
Figure 19:
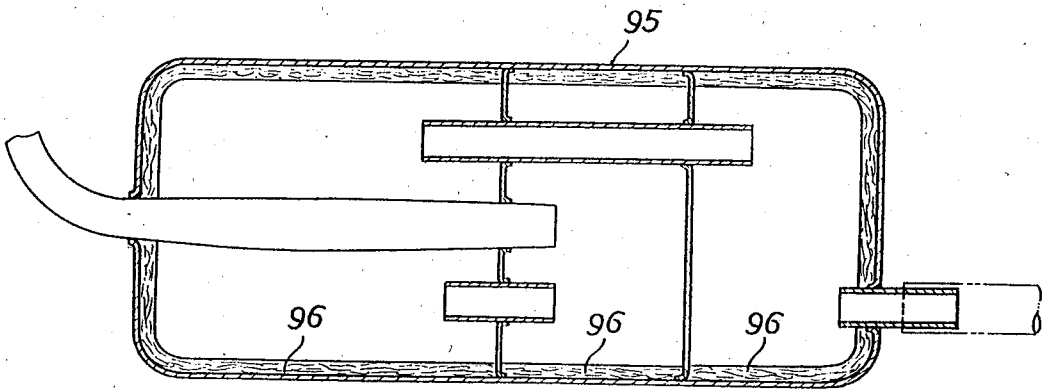
FIG. 19 PRIOR ART
FIG. 19 is a longitudinal cross-sectional view of another conventional muffler.

FIGS. 15 and 16 show a fifth embodiment which illustrates a muffler for use with a motorcylce internal combustion engine having a small displacement as with the previous embodiment.

A body (502) of a muffler 5 is constructed as a formed body of heat and sound insulation material of the type described. More specifically, ceramic fibers are mixed with elongate glass fibers to provide a laminated body which is compressed under about 200 $Kg/m^3$ to produce split halves (503), (504) having a prescribed thickness. The halves (503), (504) have a transverse cross section shown in FIG. 16 and have interfitting hooks (505), . . . on mating portions which are interengaged to form the body (502). The body (502) has on an inner peripheral wall two recesses (502*a*), (502*b*) extending fully peripherally and spaced longitudinally. Peripheral flanges (507*a*), (508*a*) of partitions (507), (508) engage in the recesses (502*a*), (502*b*), a communication pipe (522) extend between the partitions (507), (508), and a communication pipe (523) and a tail pipe (5150 are mounted on the rear partition (508).

An exhaust pipe (524) has an intermediate portion passing through a hole (502*d*) defined in a front end plate (502*c*) of the body (502) and a downstream portion (524*a*) extending into a chamber (506) in the body (502). In the embodiment, the downstream portion (524*a*) has small apertures (524*b*), . . . , and a sound absorbing material (525) composed of a wad of glass wool is disposed around the downstream portion and held by a holder (526). A grommet (527) of steel is fitted over a portion of the exhaust pipe (524) which is fitted in the hole (502*d*).

The tail pipe (515) includes an intermediate portion having small apertures (515*a*) with a wad of glass wool (528) disposed therearound and held by a holder (529). A grommet (530) is mounted on a downstream portion (515*b*) of the tail pipe (515) which extends out from a hole (502*f*) defined in a rear end plate (502*e*) of the body (502).

The interengaging hooks (505) with which the halves (503), (504) are joined are bonded together by a heat resistant adhesive interposed therebetween. The hooks (505) may comprise symmetrical tapered wedges (505*a*), (505*a*) as shown in a lower portion of FIG. 16. The flanges (507*a*), (508*a*) and the recesses (502*a*), (502*b*), and the grommets (527), (530) and the holes (502*d*), (502*f*) are also bonded together by a heat resistant adhesive interposed therebetween.

It is important that the body (502) composed of the heat and sound insulation material be impregnated at an outer surface with heat resistant synthetic resin to harden the outer surface. The synthetic resin may be impregnated in the halves as they are separated or as they are joined together. The outer surface thus hardened can provide a sufficient strength for the muffler body.

As illustrated in FIG. 16, the strength with which the halves are coupled can be increased by steel fasteners which are cross-sectionally channel-shaped and extend between hte outer surfaces of the mating portions of the halves.

According to the above embodiment, no outer panel of steel is required so that the muffler is constructed of a reduced number of parts used, simple in construction, lightweight, and less costly to manufacture.

It is belived that the present invention can be understood sufficiently based on the above description. Industrial applicability:

According to the present invention, fibrous ceramic is mixed with elongate glass fibers to provide a laminated body with its inner surface exposed in an exhaust passage leading to a source of heat and sound, thus achieving a high sound and heat insulation capability. Therefore, the present invention is particularly applicable to mufflers for internal combustion engines.

We claim:

1. A heat and sound insulation device adapted for use as a muffler through which may be flowed exhaust gases from an internal combustion engine, which comprises:

(a) an exhaust passage having peripheral walls, an inlet thereto and an outlet therefrom;

(b) a plurality of partitions in said passage to provide a plurality of compartments therealong;

(c) means for flowing exhaust gases through said compartments and out of said outlet; and (d) said peripheral walls being lined with heat and sound insulation material made by mixing enlongate glass fibers with ceramic fibers composed of 45% kaolin and 52% silicic acid to form a mass in which the ratio of ceramic fibers to glass fibers is in the range of 35 to 70 weight percent, impregnating said mass with an inorganic binder of water glass and thereafter pressing said mass in a die to a density of at least 200 $Kg/m^3$ to a predetermined shape.

2. A device as claimed in claim 1, wherein said pressed shape of fibers has outer surface portions thereof impregnated with heat resistant synthetic resin to harden such surface portions.

3. A device as claimed in claims 1 or 2, wherein said partitions are mounted with their outer periphery engaging in recesses defined in said heat and sound insulation material.

4. A device as claimed in claims 1 or 2, wherein said die pressed heat and sound insulating material is formed in two pieces to form said exhaust passage, and said partitions are formed into a unit of plural partitions, connected by a communication pipe and an exhaust pipe and said device is assembled by positioning said unit of partitions within said two pieces of heat and sound insulation material and joining the assembly together.

5. A device as claimed in claim 4, wherein said unit of partitions has an extension from an outer periphery thereof, at least one of said pieces of heat and sound insulation has a hole to mate with said extension.

6. A device as claimed in claim 2, wherein said two pieces of heat and sound insulation material have mating portions bonded together by heat resistant adhesive.

7. A device as claimed in claim 6, wherein a channel-shaped fastener is disposed between said mating portions.

8. A device as claimed in claim 2, wherein said heat and sound insulation material has an inner surface of a serrated construction composed of cross-sectionally successive grooves and ridges extending longitudinally of said exhaust passage.

9. A device as claimed in claim 2, wherein said heat and sound insulation is formed in two mating portions which provide a box shaped body defining said exhaust passage.

10. A device as claimed in claims 1 or 2, wherein said heat and sound insulation material has a tubular form and is covered with two joined halves of an outer tubular body of the heat and sound insulation material.

* * * * *